United States Patent [19]

Ferrero

[11] Patent Number: 4,593,817

[45] Date of Patent: Jun. 10, 1986

[54] CONTAINER FOR FOOD PRODUCTS, PARTICULARLY SWEET PRODUCTS, USABLE AS A MONEY BOX

[75] Inventor: Pietro Ferrero, Brussels, Belgium

[73] Assignee: Ferrero S.p.A., Alba, Italy

[21] Appl. No.: 721,763

[22] Filed: Apr. 10, 1985

[30] Foreign Application Priority Data

May 18, 1984 [IT] Italy ..... 5339/84[U]

[51] Int. Cl.[4] ..... B65D 69/00; A63H 3/00

[52] U.S. Cl. ..... 206/457; 206/216; 206/45.31; 220/4 B; 446/8; 446/73; 446/77

[58] Field of Search ..... 206/216, 457, 45.31; 220/4 E, 4 B; D99/36, 37, 38, 40; 446/8, 69–77

[56] References Cited

U.S. PATENT DOCUMENTS

| | | | |
|---|---|---|---|
| D. 21,231 | 12/1891 | Menke | D99/37 |
| D. 153,775 | 5/1949 | Dubiner | D99/40 |
| D. 193,402 | 8/1962 | Florence | D99/40 |
| 409,902 | 1/1893 | Galbreath | 220/4 E |
| 1,569,975 | 1/1926 | Hansen | 446/8 |
| 2,823,490 | 2/1958 | Greim | 229/8 |
| 2,850,156 | 9/1958 | Shane | 206/575 |
| 2,975,547 | 3/1961 | Grere | 446/77 |
| 3,520,078 | 7/1970 | Klamer | 446/73 |
| 3,587,122 | 6/1976 | Humphrey | 220/4 E |
| 4,173,667 | 11/1979 | Rusch | 206/575 |
| 4,322,004 | 3/1982 | Schwuchow | 206/575 |

*Primary Examiner*—William Price
*Assistant Examiner*—Brenda J. Ehrhardt
*Attorney, Agent, or Firm*—Bernard, Rothwell & Brown

[57] ABSTRACT

A container for food products, which can be used as a money box after consumption of the products, comprises a hollow casing constituted by two trough-shaped bodies which can be joined together releasably at their complementary free edges. One of the free edges has a notch which defines a slot with other free edge when the bodies are joined together. The two bodies have shaped appendages which give the container an animal-like appearance, and some of the appendages serve to support the container with the slot facing upwardly.

6 Claims, 3 Drawing Figures

CONTAINER FOR FOOD PRODUCTS, PARTICULARLY SWEET PRODUCTS, USABLE AS A MONEY BOX

The present invention relates to containers for food products, and is particularly concerned with a container in the form of a money box which can be used for keeping money and similar objects after consumption of the products.

The container according to the invention is characterised in that it comprises:

a hollow casing for receiving the food products, constituted by two trough-shaped bodies which can be joined together releasably in a frontal mating position and have complementary free edges, at least one of the free edges having a notch which, together with the free edge of the other trough-shaped body, defines a slot in the wall of the casing when the two trough-shaped bodies are joined together, and a laminar sealing member applied removably to the hollow casing to close the slot.

Preferably, at least one of the trough-shaped bodies has associated shaped appendages which give the container itself a zoomorphic appearance and at least some of which constitute support formations for supporting the container in a disposition in which the slot faces approximately upwardly.

By virtue of this characteristic, a container for food products, particularly sweet products, is provided which, after consumption of the products contained therein, can be used as a toy functioning as a money box.

Figure 1:
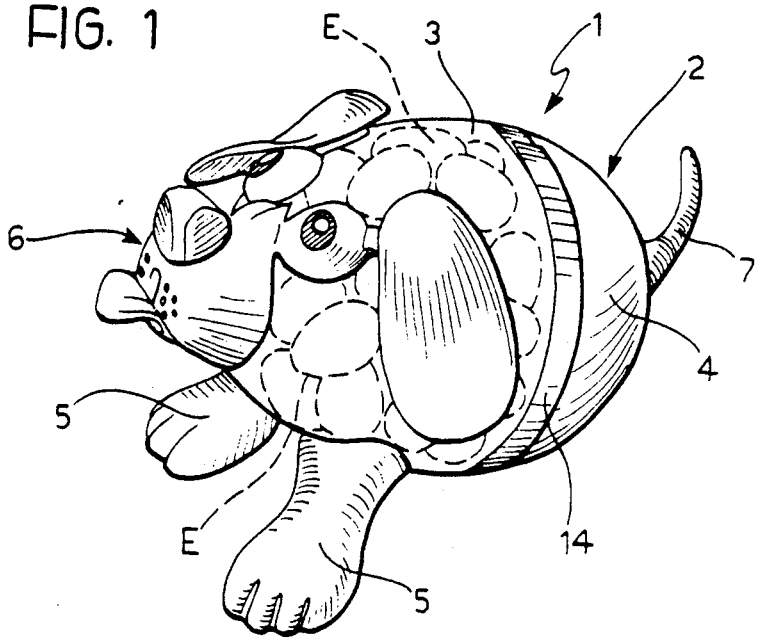
Figure 2:
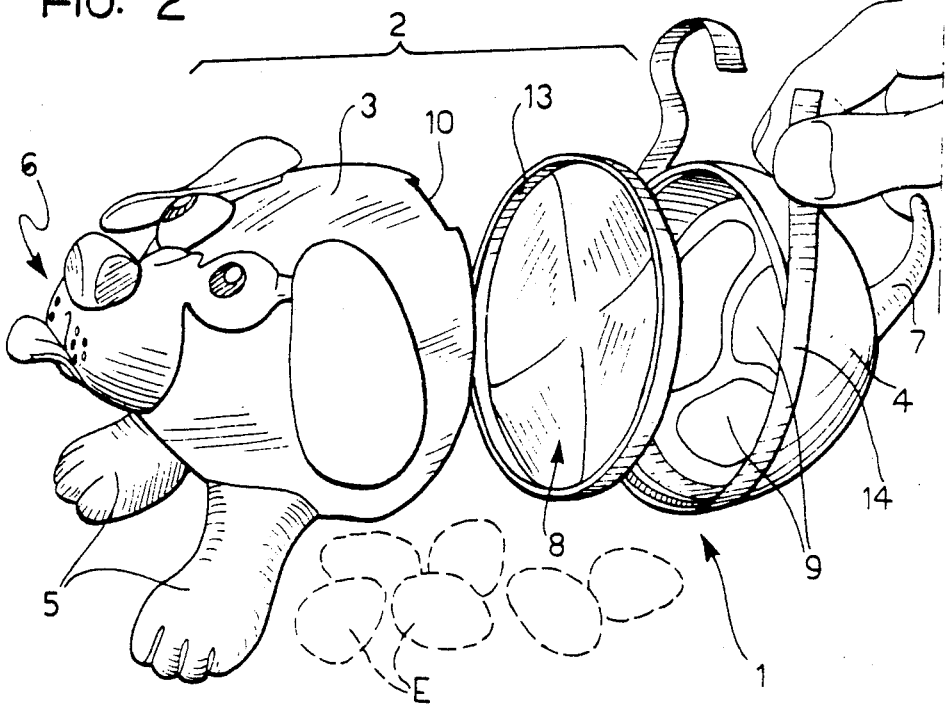
Figure 3:
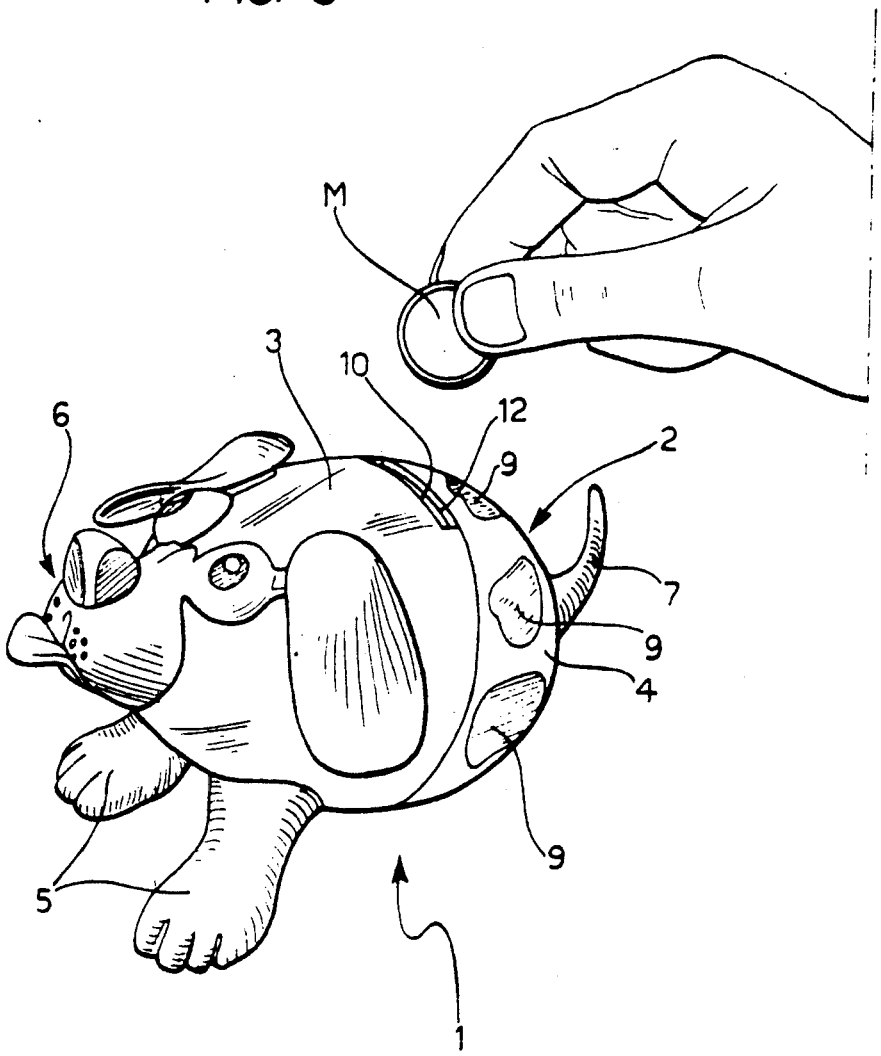

Further characteristics and advantages of the invention will become apparent from the description which follows, purely by way of non-limiting example, with reference to the appended drawings, in which:

FIG. 1 is a perspective view of a container according to the invention in a first disposition of use, FIG. 2 illustrates the container of FIG. 1 after opening, and FIG. 3 illustrates the same container in another disposition of use.

In the drawings a container for accommodating food products, particularly sweet products such as, for example, small chocolate eggs E, is indicated 1.

The container 1 is constituted essentially by a hollow casing 2 comprising two trough-shaped bodies 3, 4 which can be joined together releasably in a frontal mating position.

The two bodies 3, 4 are two half-casings of plastics material which, when joined together, together define an approximately ovoid casing.

The body 3 is made of transparent moulded plastics material while the body 4 is made of opaque plastics material.

Both the body 3 and the body 4 have shaped decorative elements applied to them, for example by ultrasonic welding, to give the container itself a zoomorphic appearance For example, in the embodiment illustrated, two lower leg-shaped parts 5 and a group of upper shaped parts 6, together defining the muzzle, eyes and ears of a small dog, are fixed to the transparent body 3.

To the bottom portion of the other trough-shaped body 4, on the other hand, is attached a further shaped part 7 defining the tail of the dog.

The legs 5 define support formations intended to support the container 1 in a position corresponding to the erect position of the animal represented thereby.

As best seen in FIG. 2, which illustrates the container 1 partially dismantled, a separator member 8 is inserted between the two bodies 3, 4 and acts as an internal partition for the casing 2 to divide the casing into two chambers corresponding substantially to the two bodies 3 and 4.

The "front" chamber of the casing 2, that is, the chamber corresponding to the body 3 on which the front legs 5 and the muzzle 6 of the dog are mounted, contains the eggs E when the container is assembled. The "rear" chamber of the casing, however, houses other decorative elements 9 constituted, for example, by adhesive labels of plastics material or cloth, the use of which will be better explained below.

The free edges of both trough-shaped bodies 3, 4 are circular. The free edge of the body 3 also has a notch 10 which, when the two bodies 3, 4 are joined together with their free edges mating, defines a slot 12 relative to the free edge of the body 4 (FIG. 3). The position of the notch 10 is selected in dependence on the position of the shaped parts (the legs 5) defining the support formations of the container so that, when the container is disposed on a flat surface, the slot 12 faces more or less upwardly.

Preferably, the separator member 8 has a generally dished configuration in which it is possible to distinguish a curved or dished bottom wall and a cylindrical side wall 13 extending along a circular path with a diameter slightly less than the diameter of the circular path along which the free edges of the two bodies 3 and 4 extend.

On assembly of the container, the separator member 8 is applied as a cover to the body 4 after the decorative elements 9 have been inserted in the body.

Subsequently, the closed body 4 is connected to the body 3 in which the small eggs E have been placed. The connection of the two bodies is generally effected by snap-engagement of the free edges of the two bodies 3, 4, which have complementary profiles.

The isolation of the front and rear chambers of the casing from the exterior is made more effective by an annular band 14 of adhesive material which is wrapped around the casing 2 to cover the zone of connection between the two bodies 3, 4. The adhesive band 14 extends as a sealing cover for the notches 10, further reinforcing the connection between the bodies 3, 4.

The assembled container has the appearance illustrated in FIG. 1.

In order to consume the small eggs E, the user removes the adhesive band 14, as shown schematically in FIG. 2, separating the two bodies 3 and 4. The chamber containing the eggs E is thus made accessible to allow the removal of the products contained therein.

After the consumption of the eggs E, the container 1 may be re-assembled, the separator member 8 being removed after the decorative elements 9 in the body 4 have been taken out.

In the new configuration of assembly, the container 1 takes on the overall appearance illustrated in FIG. 3. In this condition, coins M, bank notes, and similar objects to be kept may be introduced into the casing 2 through the slot 12 defined by the notch 10.

Thus, in this second disposition of use, the container 1 serves as a money box.

The elements 9 taken from the body 4 may be stuck onto one of the bodies 3, 4 in order to decorate the container further.

In the embodiment illustrated, the decorative elements 9 may be applied to the container 2 so as to simulate the patches of the animal represented by the container 1.

What is claimed is:

1. A container for food products, which can be used for keeping money and similar objects after consumption of the products, comprising:

a hollow casing for receiving the food products, the hollow casing having a zoomorphic appearance and being constituted by two hollow trough-shaped bodies which can be joined together releasably in a frontal mating position generally transversely along the hollow casing, the trough-shaped bodies having complementary free edges forming a zone of connection, at least one of the free edges defining a notch which, together with the free ends of the other trough-shaped body, forms a transverse slot in the wall of the casing when the two bodies are joined together, a partitioning separator member enclosed within the casing fitted releasably within the casing to divide the casing into portions defining two chambers, one of said chambers being intended to receive the food products, and a laminar sealing member applied removably to the casing to close the slot, the sealing member being in the form of an annular band which can be wrapped around the hollow casing in the zone of connection between the two trough-shaped bodies.

2. A container as defined in claim 1, carrying associated decorative members for application to the container, a second chamber of said two chambers being intended to receive decorative elements.

3. A container as defined in claim 2, wherein the portion of the casing defining the chamber intended to receive the food product is made from transparent material and the portion of the casing defining the chamber intended to receive the decorative elements is made of opaque material.

4. A container as defined in claim 1, wherein at least one of the trough-shaped bodies has associated shaped appendages which give the container a zoomorphic appearance at least some of said appendages constituting support formations for supporting the container in a disposition in which the slot faces approximately upwardly.

5. A container as defined in claim 2, wherein at least one of the trough-shaped bodies has associated shaped appendages which give the container a zoomorphic appearance at least some of said appendages constituting support formations for supporting the container in a disposition in which the slot faces approximately upwardly.

6. A container as defined in claim 3, wherein at least one of the trough-shaped bodies has associated shaped appendages which give the container a zoomorphic appearance at least some of said appendages constituting support formations for supporting the container in a disposition in which the slot faces approximately upwardly.

* * * * *

UNITED STATES PATENT AND TRADEMARK OFFICE

CERTIFICATE OF CORRECTION

PATENT NO. : 4,593,817

DATED : June 10, 1986

INVENTOR(S) : Pietro Ferrero

It is certified that error appears in the above-identified patent and that said Letters Patent is hereby corrected as shown below:

Column 3, line 22, "ends" should be --edge--.

Signed and Sealed this

Sixteenth Day of December, 1986

*Attest:*

DONALD J. QUIGG

*Attesting Officer*

*Commissioner of Patents and Trademarks*